US006142215A

United States Patent [19]

Paulsen et al.

[11] Patent Number: 6,142,215

[45] Date of Patent: Nov. 7, 2000

[54] PASSIVE, THERMOCYCLING COLUMN HEAT-EXCHANGER SYSTEM

[75] Inventors: Dwight C. Paulsen, Slidell; Leon G. Barnett, Metairie; Timothy J. Moreau, Lacomb, all of La.

[73] Assignee: EDG, Incorporated, Metairie, La.

[21] Appl. No.: 09/134,131

[22] Filed: Aug. 14, 1998

[51] Int. Cl.[7] ..... F28D 3/02

[52] U.S. Cl. ..... 165/45; 165/128; 165/129

[58] Field of Search ..... 165/45, 128, 129, 165/132, DIG. 409

[56] References Cited

U.S. PATENT DOCUMENTS

| | | | |
|---|---|---|---|
| 735,449 | 8/1903 | Berger . | |
| 1,913,573 | 6/1933 | Turner . | |
| 2,193,309 | 3/1940 | Wheless . | |
| 3,251,401 | 5/1966 | Gardner, Jr. | 165/129 X |
| 3,448,792 | 6/1969 | Lawrence | 165/128 X |
| 3,472,314 | 10/1969 | Balch . | |
| 3,648,767 | 3/1972 | Balch . | |
| 3,685,583 | 8/1972 | Phares | 165/128 X |
| 3,802,498 | 4/1974 | Romanos | 165/DIG. 409 |
| 3,874,174 | 4/1975 | Greene | 165/45 X |
| 4,040,476 | 8/1977 | Telle . | |
| 4,043,289 | 8/1977 | Walter . | |
| 4,050,511 | 9/1977 | McDonald | 165/DIG. 407 |
| 4,220,202 | 9/1980 | Aladiev et al. | 165/45 X |
| 4,924,936 | 5/1990 | McKown . | |
| 5,024,553 | 6/1991 | Katsuragi | 165/45 X |
| 5,573,060 | 11/1996 | Adderley . | |
| 5,803,161 | 9/1998 | Wahle et al. . | |

FOREIGN PATENT DOCUMENTS

| | | | |
|---|---|---|---|
| 1068086 | 1/1984 | U.S.S.R. | 165/45 |
| 2074711 | 11/1981 | United Kingdom | 165/132 |

*Primary Examiner*—Leonard Leo
*Attorney, Agent, or Firm*—Joseph T. Regard, Ltd

[57] ABSTRACT

A heat exchanger system suitable for facilitating the economical cooling of hot fluids in the vicinity of a body of water. The preferred embodiment of the present invention contemplates a vertical, or combination vertical and horizontal thermosyphonic, passive, heat exchanger column situated in a body of water and enveloped by a caisson or the like, and configured to facilitate, through percolation, enhanced circulation of seawater therethrough and effecting significant cooling of a hot, hydrocarbon well stream, or other hot fluid in the vicinity of a body of water. A vertically situated bundle of tubes forms the heat exchanger, which may include a system of staggered baffles to direct the flow of cooling seawater to effect even temperature distribution throughout the tube bundle. The present system further teaches a system for cooling high pressure, hot fluids as may be found in a deep hydrocarbon reserve offshore, utilizing a the vertical heat exchange column of the present invention. Upon passing through the system, a gaseous fluid stream, significantly cooled, should experience a commensurate pressure reduction and allow the use of conventional pipeline materials. The present system dispenses with the necessity of providing expensive, pro-active cooling, generally expending significant fuel, or the necessity of constructing an expensive, high pressure, non-corrosive pipeline of, for example, titanium or the like.

19 Claims, 9 Drawing Sheets

PASSIVE, THERMOCYCLING COLUMN HEAT-EXCHANGER SYSTEM

TECHNICAL FIELD OF THE INVENTION

The present invention relates to heat exchangers, and in particular to a heat exchanger system suitable for facilitating the economical cooling of hot fluids, particularly high pressure gasses, in the vicinity of a body of water. The preferred embodiment of the present invention contemplates a vertical, or combination vertical and horizontal thermosyphonic, passive, heat exchanger column situated in a body of water and enveloped by a caisson or the like, configured to facilitate percolation and circulation of fresh water or seawater therethrough and effecting significant cooling of a hot, hydrocarbon, well stream of gas or other hot fluid. A vertically situated bundle of tubes forms the heat exchanger, which may include a system of baffles to direct the flow of cooling seawater, so as to provide more efficient heat transfer throughout the tube bundles.

The system of the present invention further teaches a system for cooling high pressure, hot fluids such as natural gas or the like as may be found in deep reserves offshore, utilizing a the vertical heat exchange column. Upon passing through the system, a gaseous fluid stream is significantly cooled, allowing the use of conventional pipeline materials. The present system dispenses with the necessity of providing expensive, pro-active cooling equipment, generally expending significant fuel to operate, or the necessity of constructing an expensive, high pressure, non-corrosive pipeline of, for example, titanium or the like.

BACKGROUND OF THE INVENTION

While heat exchangers formed from bundles of tubes, thermosyphonic heat exchangers, and the utilization of heat exchangers in hydrocarbon production is not per se new, none are believed to teach or suggest the concepts embodied in the present invention.

In hydrocarbon production, heat exchangers have been employed in some capacity to heat up recovered fluids in cold areas such as Alaska or the like, to facilitate better flow or prevent the formation of hydrates, ice, or other matter within the pipeline. Prior art teachings further include, as further discussed infra, so-called keel coolers as employed in vessels and offshore platforms, which may include a bundle of three or more tubes which may directly engage a cooling body of water, such as an ocean or the like; in a vessel, the keel cooler may be located adjacent to the keel, exterior of the vessel, hence the name.

Recent advances in geophysical exploration methods have located deeper oil and gas reservoirs. Production from these reservoirs is significantly hotter than shallower production. The hotter production must be cooled before it can be economically pipelined or processed. For transport by subsea pipeline, the production must be cooled to 150–160 degrees F. or expensive materials and special designs will be required. For gas processing, separation, sweetening, and dehydration—the gas is normally cooled to 120–130 degrees F. or less. The gas cannot be effectively processed at a higher temperature. In addition, chlorides associated with aqueous phase attacks stainless steel at temperatures above 130–135 degrees F., so there exists a universal need for an economical means to cool hydrocarbon production on an offshore platform.

From a satellite facility, where offshore gas and oil wells are produced, the produced fluids are usually pipelined to a Central Processing Facility (CPF). The hot well fluids must be cooled prior to entering the pipeline. A high temperature fluid passing through the pipeline causes extensive pitting and metal loss, with alloy steel or nickel alloys particularly, at the waterline. One possible solution is to construct the hot upstream section of the pipeline with a double wall system, which will keep the outside of the pipe from getting too hot. This type of construction, however, is expensive, and is estimated to cost approximately twice as much as a single wall pipeline.

Alternatively, the gas may be cooled on the satellite platform before introduction to the pipeline. Conventional cooling methods include fin-fan coolers or seawater cooling via traditional heat exchangers. One method in common use is the fin-fan cooler, in which the production is directed to a large array or bank of finned tubes. Air is blown across the tubes with a motor driven blower to cool the tubes. Fin-fan coolers are usually quite large, heavy, and installed on the top deck of the platform, where space is at a premium, to obtain good cooling efficiency. The fan motor is usually driven by electricity, thereby requiring a power supply at the platform. Electricity is either generated by an on-site gas-driven turbine/generator set, or can be transmitted from a nearby platform with a subsea cable. An offshore turbine generator installation is generally large, complex, and expensive. It requires a large deck space and a continuous supply of clean natural gas. The clean gas must be pipelined from the CPF or other facility where a sufficient supply of clean gas is available.

For a 50 million SCFD gas flow rate produced at 300 degrees F., a system for cooling to a temperature of 160 degrees F. would consist of a 13 MM (million) Btu/hr fin-fan cooler with two (2) 50 HP electric motors. The cooler requires a 15×30 foot area of deck space, and would use about 850,000 Btu/hr of energy as natural gas to drive the fans. At a gas price of $2.50/Million Btu, this results in an annual cost of $18,500. The capital cost for the cooler, generator set, fuel gas line, motor controls, and platform is estimated to exceed $2,000,000.00.

The below patents are cited as having at least cursory pertinence to the concepts enunciated in the present invention:

| Patent Number | Inventor | Date of Issue |
|---|---|---|
| 5573060 | Adderley et al | 11/12/1996 |
| 4924936 | Mckown | 05/15/1990 |
| 4043289 | Walter | 08/23/1977 |
| 4040476 | Telle et al | 08/09/1977 |
| 3648767 | Balch | 03/14/1972 |
| 3472314 | Balch | 10/14/1969 |
| 2193309 | Wheless | 03/12/1940 |
| 1913573 | Turner | 06/13/1933 |
| 735449 | Berger | 08/04/1903 |

U.S. Pat. Nos. 3,648,767 and 3,473,314 teach thermosyphonic systems to facilitate circulation of fluid to be thermally affected in a heat exchanger.

U.S. Pat. No. 735,449 teach a jacketed heat exchangers to affect temperature on hydrocarbons recovered from a well. U.S. Pat. No. 2,193,309 teaches a heat exchanger system for warming high pressure gas wells, so as to the prevent formation of snow or ice particles or the like; other systems taught heating of gas to prevent formation of hydrates.

Heat exchangers incorporating an array of tubes to form a bundle configuration is taught to some extent in U.S. Pat. No. 1,913,573 for a Radiator dated 1933. Note also U.S. Pat.

No. 4,040,476 for a "Keel Cooler with Spiral Fluted Tubes", which system is submerged in a marine environment to cool the fluid therein. See also U.S. Pat. No. 4,043,289 which contemplates a keel cooler including a tube bundle. U.S. Pat. No. 5,573,060 is another example of heat exchangers directly employed in seawater.

Geothermal heat exchange systems may employ exchange from one medium to another, including cold depths of a water body to warmer shallows of the same body, although none are believed to contemplate the apparatus or methodology of the present invention.

Lastly, U.S. Pat. No. 4,934,936 teaches a "Multiple, parallel packed column vaporizer" that contemplates a bundle of tubes jacketed in an enclosure for heat exchange.

While heat exchangers have been employed in seawater, some discussed above, there exists a significant problem in deploying high pressure, high temperature heat exchangers directly in salt water, because any direct contact of the metal forming the heat exchanger with sea water may cause same to boil, facilitating tremendous corrosion and/or pitting problems for most metals, ferrous and non-ferrous; most grades of stainless steel and aluminum are not immune to this problem.

Recent advances in hydrocarbon recovery techniques have resulted in successful wells in high depth reserves deep offshore. Recovery of gasses from these areas has facilitated new problems heretofore unexperienced in the industry. For example, natural gas from deep reserves exits the production platform at both a high temperature and high pressure, presenting problems associated with containment as well as corrosion of the system due to the salt water environment, as discussed supra.

Because standard pipelines cannot handle the pressure and high corrosion, there has been some discussion of employing expensive titanium pipelines, but the cost would be generally cost prohibitive and dangerous to maintain long high pressure system. Chokes or the like may be employed to reduce the pressure to some extent, but the real answer in facilitating satisfactory production is to reduce the temperature of the stream, which will allow the use of conventional pipelines and cost effective treatment facilities. As may be discerned by a review of the above, the known prior art has failed to contemplate such a system.

GENERAL SUMMARY DISCUSSION OF THE INVENTION

Unlike the prior art, the present invention contemplates a system for cooling high pressure, hot fluids from deep hydrocarbon reserves offshore, generally comprising a vertical heat exchange column (formed of a bundle of tubes) enveloped by a caisson or the like in order to facilitate percolation of seawater, so as to create a thermosyphonic effect, wherein seawater is drawn into and up the caisson, engaging the heat exchanger containing the hot fluid, cooling same utilizing the abundant supply of cold water in the area.

The present invention installed upon an offshore platform, for example, would require very little platform deck space, and no power requirements. Thermosyphonic effect is a passive process, utilizing convective and conductive heat transfer from the hot fluid in a method that is uniquely efficient and cost effective. Requiring no operator attention or regular maintenance, the invention provides the advantages of simplicity, no moving parts, complete safety, and environmentally benign. It is estimated that the invention can be installed on to an offshore platform for cooling a 50 million CFD gas flow from 300 degrees to 160 degrees F. for $500,000.00 or less.

The tube bundle, which may be enveloped by a shell to facilitate more efficient heating and percolation action, is enveloped by the caisson, forming a shell about the unit. A hot fluid, preferably hotter than 212 degrees F. (to form steam), is cooled by feeding it through the top of the apparatus and along its length, passing out of the bottom. The tube bundle may be formed of longitudinally aligned tubes measuring, for example ½" to 1" in diameter, having a length of 20 to 100 feet, depending upon the application. At the top of the bundle, fluid flow enters the tube bundle from a single inflow pipe, and, at the bottom of the bundle, the flow returns to a single outlet pipe.

The heat exchanger and shell are inserted into the caisson until the unit is submerged in seawater. When hot fluid passes down through the tube bundle, the seawater within the shell becomes heated, causing same to boil as it rises to the top of the tube bundle. A percolation tube, having a lesser diameter than the tube bundle, is situated at the top of the shell, above the tube bundle, to receive the boiling water. The steam bubbles rising through the unit, and particularly rising through the percolation tube, causes a pumping action or gas lift, similar to the action of a percolator coffee pot. The steam and heated water rise to the upper part of the caisson, and flow out of egress apertures, back into the sea.

The pumping action draws seawater into the bottom of the caisson and shell, urging same to flow through the heated tube bundle, where circulation continuous as long as the tube bundle is heated. Heat transfer from the hot tube bundle to the seawater cools the fluid within the tube bundle, resulting in a significant temperature reduction upon leaving the system, and so reducing pressure the temperature of the well stream to the use of conventional pipeline materials for further transport, and dispensing with the necessity of expensive pipelines formed of unconventional or exotic materials.

The system may further include a system of staggered baffles to direct the flow of cooling seawater evenly throughout the tube bundles, enhancing and better distributing the coolant flow throughout the tube bundle.

It is therefore an object of the present invention to provide a heat exchanger system suitable for high pressure, high temperature applications utilizing water as a cooling agent.

It is another object of the present invention to provide a method of effectively cooling high temperature, high pressure hydrocarbons to facilitate transport of same through standard pipelines in a saltwater environment.

It is still another object of the present invention to provide a heat exchanger system in a body of water which facilitates passive, yet enhanced circulation of water therethrough utilizing a thermosyphon technique which is enhanced via percolation of the coolant.

It is another object of the present invention to provide a heat exchanger column formed from a bundle of tubes which is enveloped by a caisson or the like which is baffled to facilitate generally uniform heat dissipation therethrough.

Lastly, it is an object of the present invention to provide a heat exchanger which is more efficient, easier to maintain, and far less expensive to operate than prior art systems.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 4:
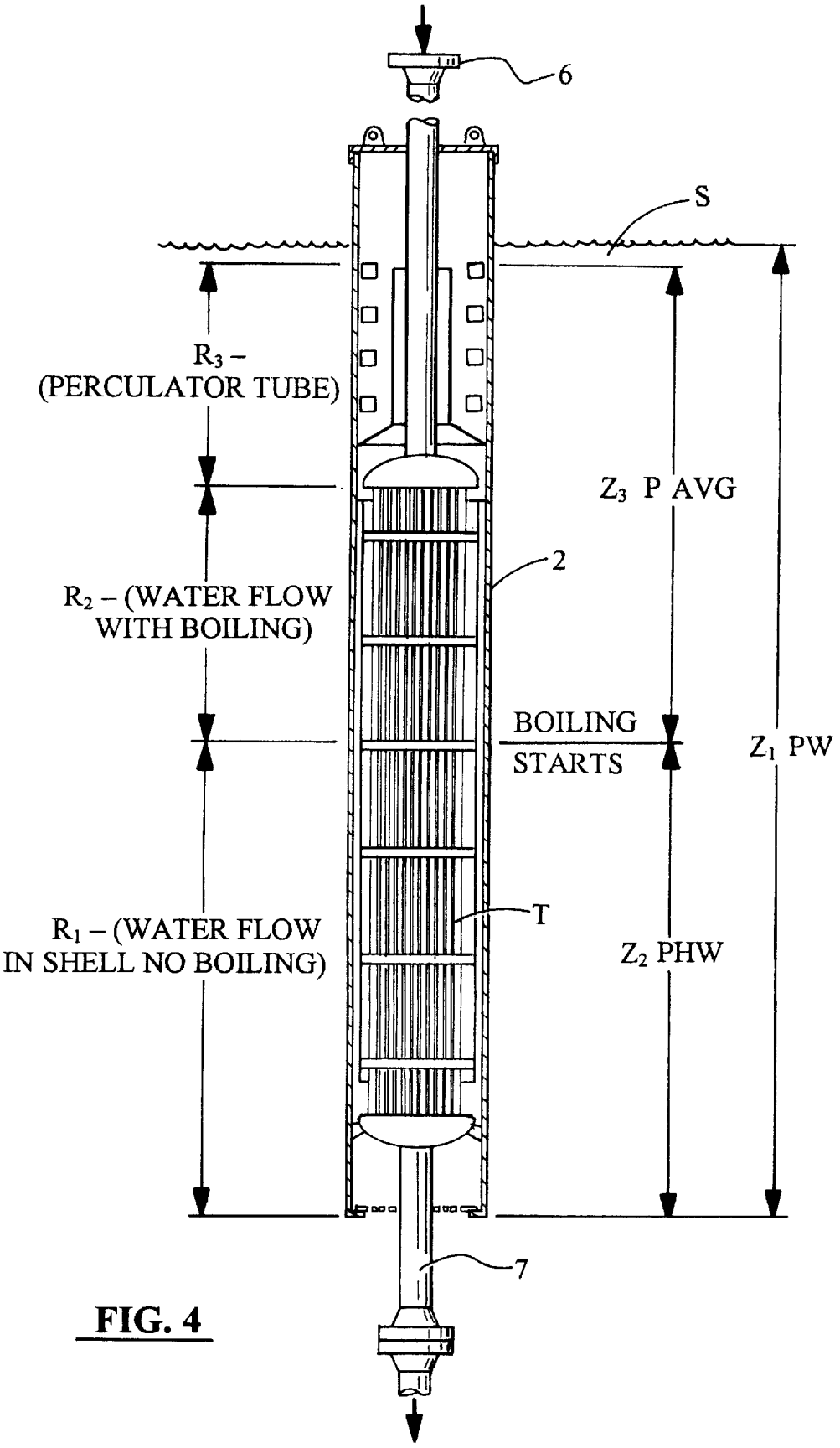
FIG. 4 is side, partially cross-sectional view of the system of FIG. 1, illustrating the thermosyphonic flow of the system.
Figure 5:
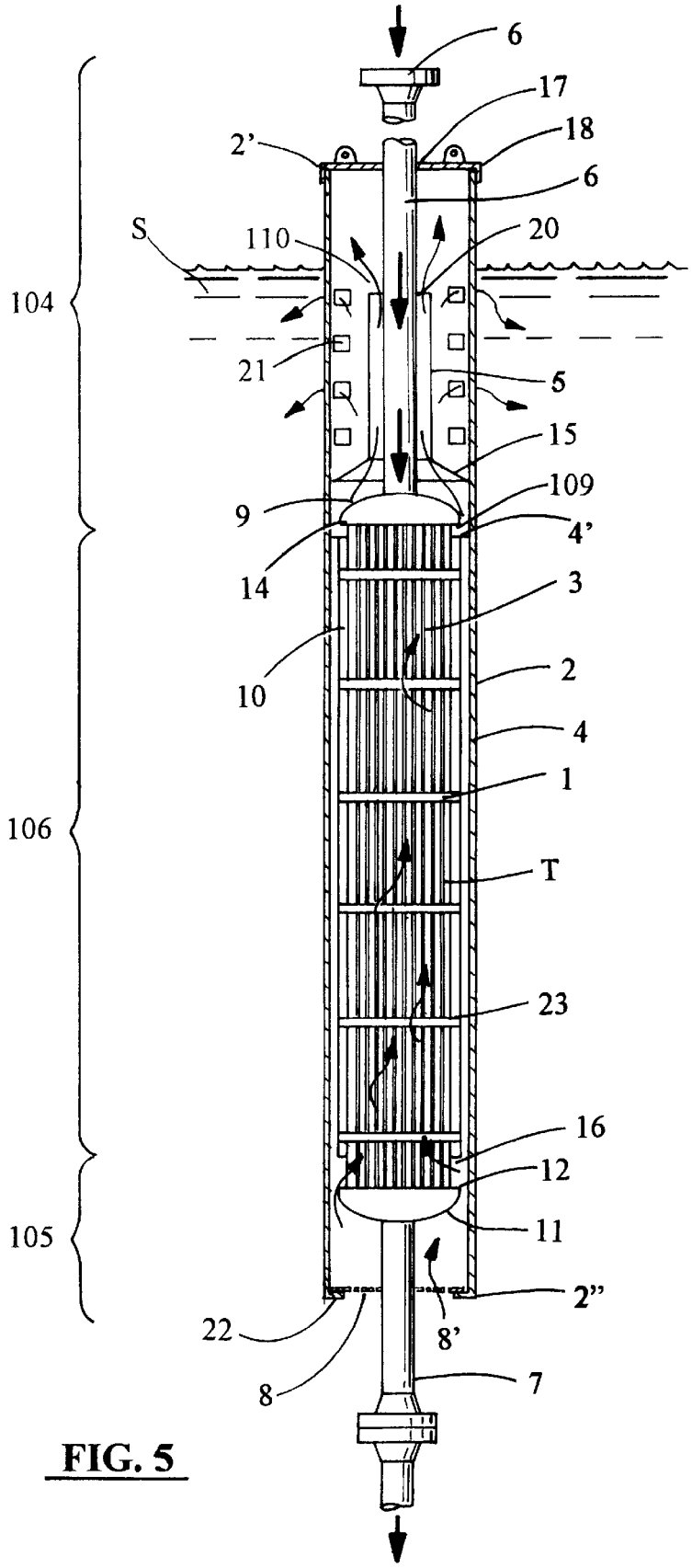
FIG. 5 is a side, cut-away view of the system of FIG. 1, illustrating the the tube bundle, the shell, the percolator tube and hot fluid inlet and outlet forming the preferred embodiment of the vertical column heat exchanger of the present invention, further including the caisson enveloping member, as well as the flow of seawater through and around the heat exchanger.
Figure 6:
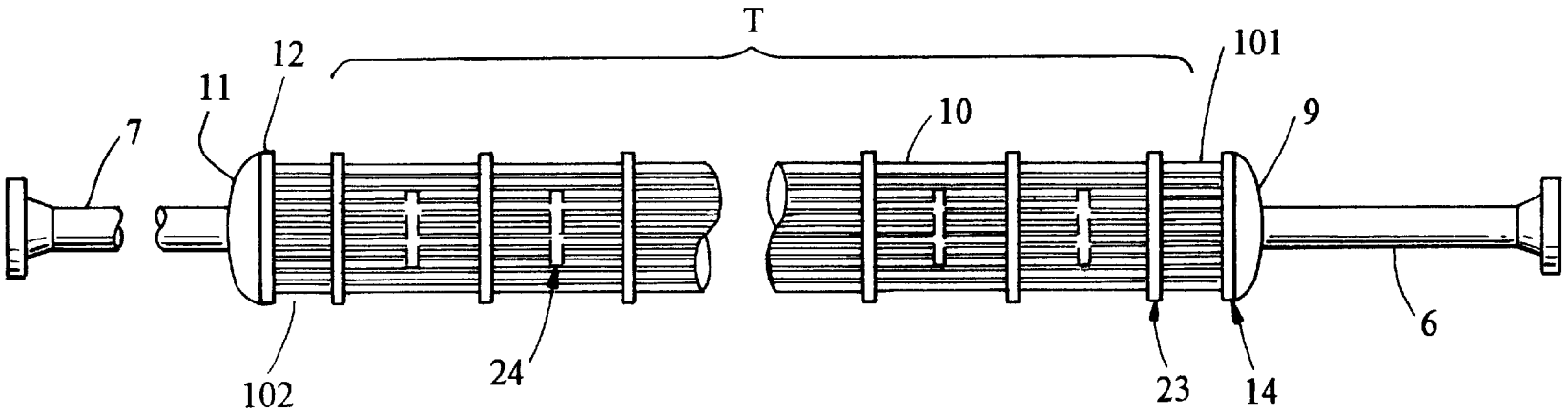
FIGS. 6 illustrates the tube bundle of the preferred embodiment of the present invention.
Figure 6C:
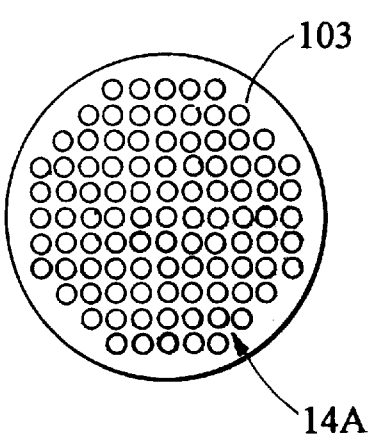
FIGS. 6A–6C the configuration of the baffles doughnut baffle, disc baffle, and tube sheet of the present invention, respectively.
Figure 6B:
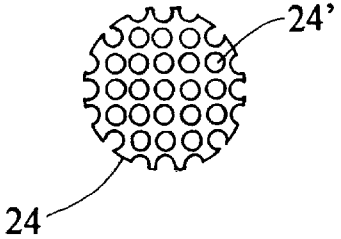
Figure 6A:
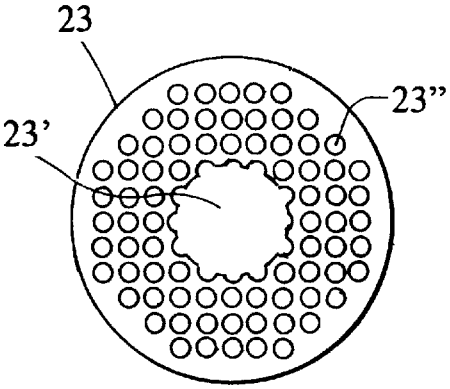

Referring to FIGS. 6–6C as well as FIGS. 4 and 5, the preferred embodiment of heat exchanger 1 of the present invention includes a tube bundle T (30' length in the exemplary embodiment) comprising a plurality of longitudinally aligned tubes, the tube bundle having first 101 and second 102 ends having first 9 and second 11 spherical or elliptical head caps affixed thereto, respectively, each head cap 9, 11 securely attached and closed off by tube sheets 14, 12 (individually shown as 14A in FIG. 6C) configured to sealingly engage and hold a plurality of heat exchanger tubes 10 forming the tube bundle, while allowing flow through the tube bundle, allowing flow from a supply line (3" diameter in the exemplary embodiment).

The tube bundle is fitted inside of a thin wall shell 4, formed with a conical section 15 at the top that is flared to fit the inside diameter of a caisson 2. The shell is cut at the lower end 16 a distance of about, for example, 6" from the bottom tube sheet. A bottom opening is provided to allow seawater to enter the shell and engage the tube bundle.

The tubes 10 are fitted into the holes 103 formed in the tube sheets 14A. The tube ends forming the ends 101, 102 of the tube bundles may be rolled and/or welded, or both to the tube sheet. The tube sheets 12, 14, 14A seallingly engage the tube ends forming the bundle to prevent the migration of seawater into the head caps, while allowing the flow of hot fluid therethrough. The head caps, tube sheets with tubes, and baffles make up the tube bundle.

The tube sheets 14, 12 hold the tubes forming the bundle T apart on a specific, generally evenly spaced pattern, which is maintained throughout the length of the tubes by alternating, generally uniformly spaced doughnut baffles 23 and disc baffles 24 placed along the length of the tubes.

Doughnut baffle 23 has a diameter generally commensurate with the outer diameter of the tube bundle T, and has formed therein a plurality of holes 23" (in the exemplary embodiment, 25/32" diameter) configured for the passage of individual tubes (slightly greater than ¾" diameter in the exemplary embodiment) forming the tube bundle, further having formed therein an inner core passage 23' formed therethrough, while the disc baffle 24' has a outer diameter generally commensurate with the diameter of the core formed in the doughnut baffle, also including holes 24 for the passage of individual tubes 10 forming the tube bundle T.

Baffles are installed along the length of the tubes, and spaced to cause seawater cross flow through the tube bundle, within the shell, and thereby enhance heat transfer. The spacing of the baffles ideally are optimized for maximum heat transfer while balanced against frictional pressure drop through the bundle. The baffles illustrated in FIGS. 6–6C are the disc and doughnut type and cause the water to flow across the tubes. Segmented baffles may also be used.

In the preferred embodiment of the invention, the doughnut baffle 23 and the disc baffle 24 are evenly spaced and alternated along the length of the tubes, in order to support the tubes and to channel the seawater flow around the baffles and across the tubes, thus enhancing the heat transfer of the seawater coolant throughout the tube bundle, on the seawater side.

The exemplary tube pattern shown is square, with, for example, a 1" spacing (pitch), measured from tube centerline to tube centerline. Other tube patterns are possible and may be used to enhance the heat transfer and/or increase the tube surface area if necessary, depending upon the circumstances of use. The tube sheets may also be attached to the heads with a flange arrangement instead of welding. As shown, an identical head 11, tube sheet 12 and outlet pipe 7 are fitted to the lower end.

The preferred embodiment of the present invention includes the tube bundle FIG. 6 situated in a generally vertical configuration, and, continuing with FIG. 5, is enveloped about its length by an elongated hollow caisson 2 that is ideally somewhat open at its upper 2' and lower 2" ends, forming a coolant egress area 104 and ingress area 105, respectively, with a thermal transfer area 106 medially situated therebetween which is itself enveloped by shell 4. The temperature conversion zones in the present system are further indicated in FIG. 4.

Continuing with FIGS. 4 and 5, as shown, the enveloping caisson has a length greater than the length of the tube bundle T, so as to fully envelope the tube bundle, with a length of said caisson extending above said tube bundle, forming the egress area 104, and below the tube bundle, forming the ingress area 105.

A cover 17, affixed to the upper 2' end, may be provided with a lip or short cylindrical section 18, securely attached to the cover, a cylinder of a diameter which fits loosely over the cylindrical caisson 2. The caisson 2 has formed therein, along the upper section provided with a plurality of apertures 21, illustrated as a square but may be other shapes, there around, near and below the design water S level, the purpose for which will be described in detail later.

The lower end 2" of the caisson 2 may include an internal ring 22 securely attached to the inside diameter, in the vicinity of the opening for the purpose of mounting a wire mesh screen. The purpose of the screen is discussed elsewhere in this application.

Continuing with FIG. 5, a shell 4 or percolator case having a length generally equal to the length of the tube bundle T, having a diameter less than caisson 2 but more than tube bundle T so as to envelope the tube bundle T, to loosely fit around the baffles 19 so that a minimum of water passes up between the baffles and the shell.

The top of the shell is constructed with a flared or expanded section 4' fitted to the caisson wall, and allowing sufficient area 109 for the water and steam to pass around the tube sheet 14 and head 9.

In the preferred embodiment of the present invention, the upper part of the shell is a truncated cone 15 or funnel that is attached to a percolator tube 5, which is shown having a diameter less than the diameter of the tube bundle, but greater than and enveloping the inlet pipe 6, configured to provide an enhanced gas lift action to pump seawater through the tube bundle. The size of the annulus is dictated by the diameter of the inlet pipe and the percolator tube. The percolator tube diameter and length may be varied to produce the maximum pumping action and the maximum cooling of the hot fluid.

The tube bundle T and the percolator case 4 may be constructed independently, and may be inserted after jacket installation. The tube bundle T and percolator case 4 are made to be removable from the caisson, for purposes of inspection and maintenance.

A wire mesh screen 8 is installed with fasteners across the opening at the bottom 2" of the caisson. The wire diameter and mesh size are designed to exclude certain types of marine life that may tend to block or hinder the action of the heat exchanger.

Figure 1:
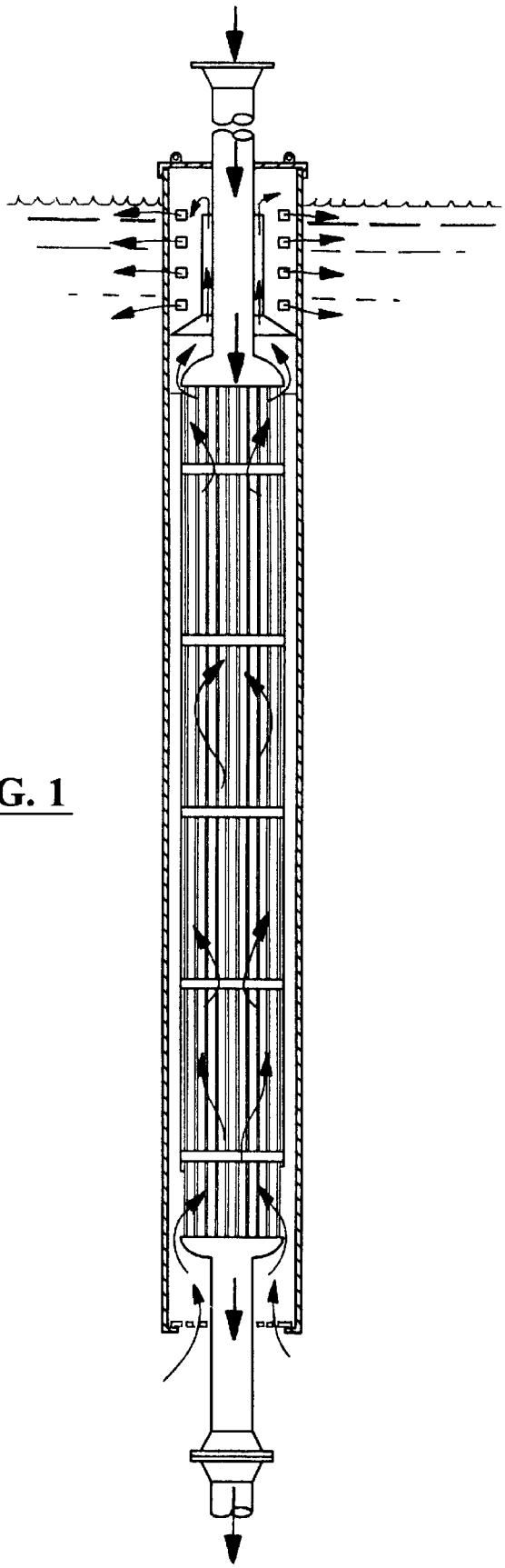
FIG. 1, is a side, partially cut-away view of the preferred embodiment of the present invention immersed in a body of water, configured for use in a production installation for the production of natural gas.
Figure 2A:
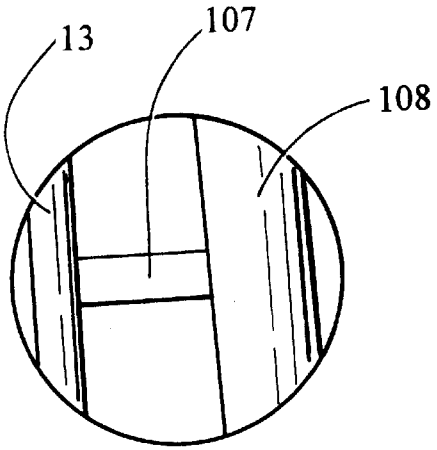
FIG. 2A is a close-up, side view of the installation of the invention of FIG. 1 to an exemplary offshore structure.
Figure 2:
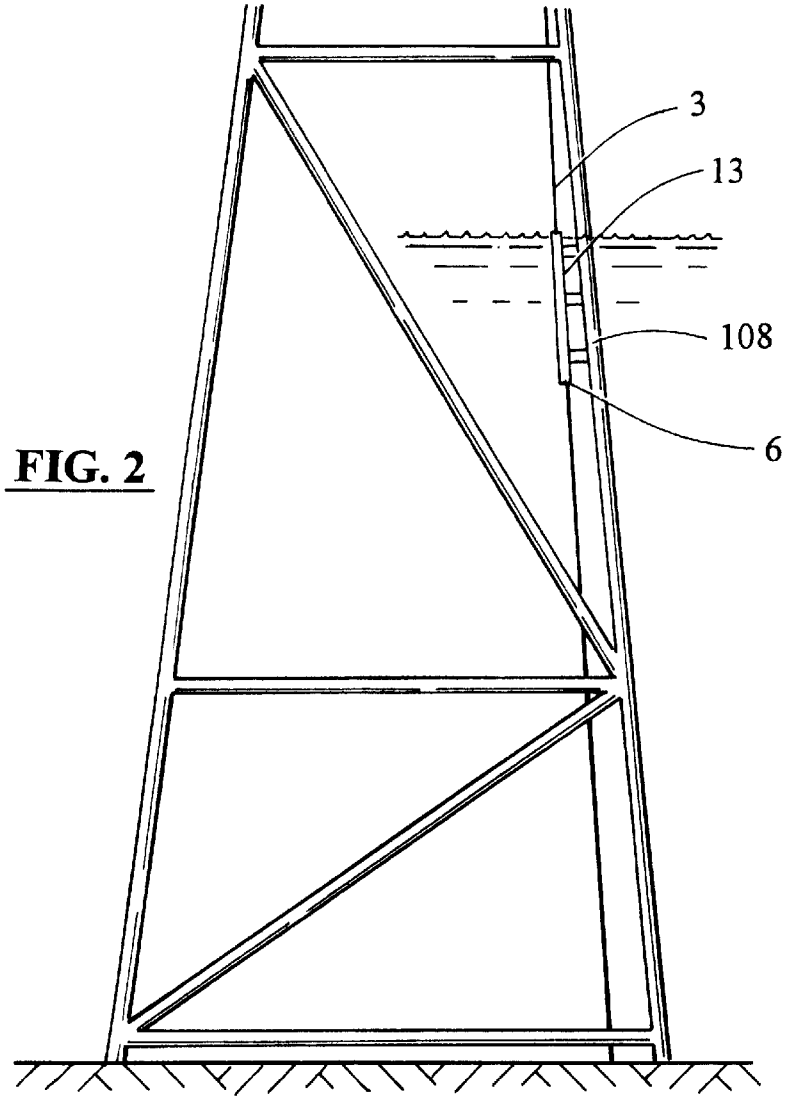
FIG. 2 is a side view of an exemplary installation of the invention of FIG. 1, immersed in a body of water and installed upon an offshore platform.
Figure 3:
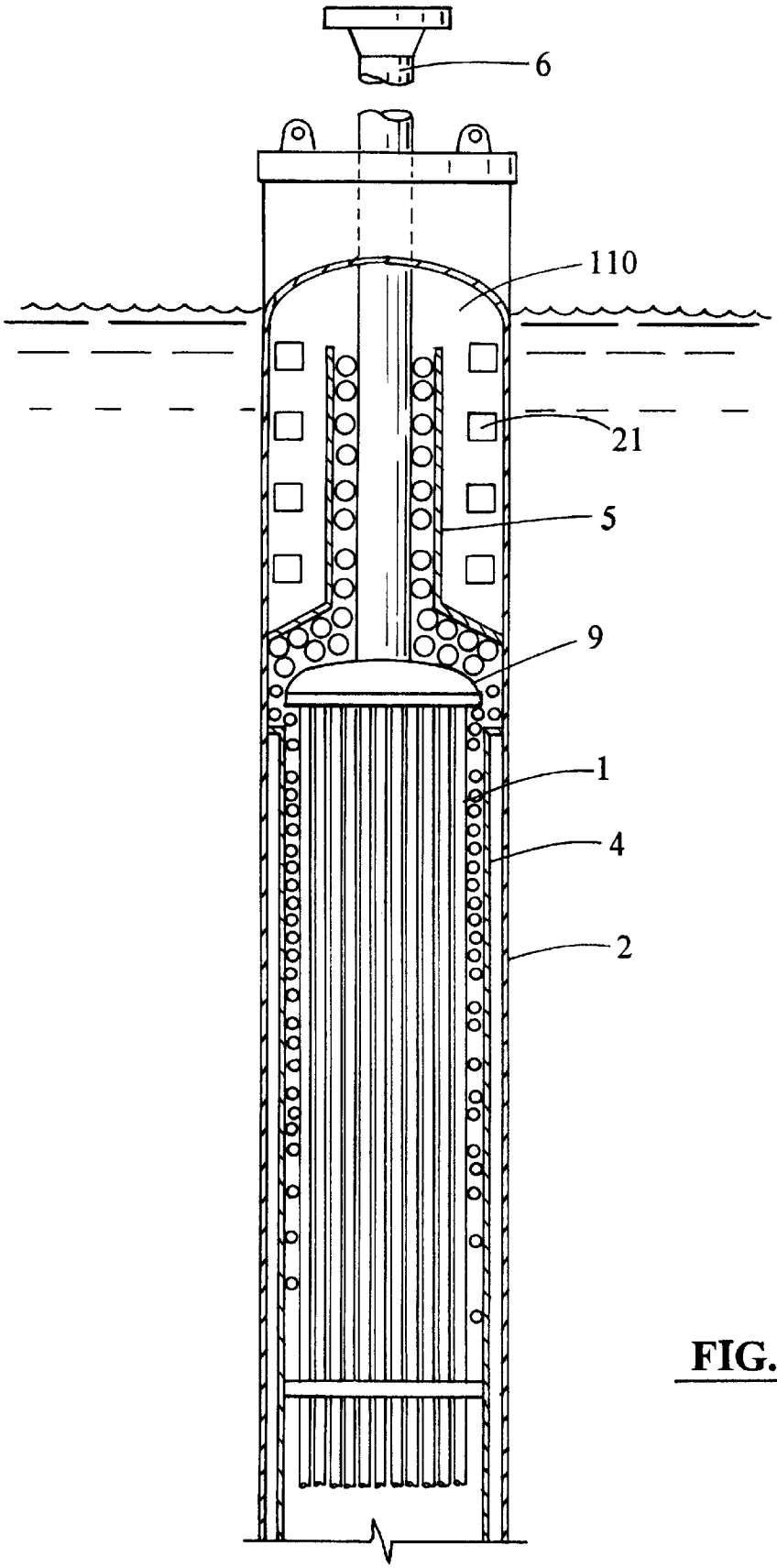
FIG. 3 is a side, partially cross-sectional, partially cut-away view of the top of the heat exchanger of FIG. 1 illustrating the formation and circulation of steam bubbles up the percolation tube.

The caisson 2 is securely fastened to a jacket forming one of the platform legs via weld, clamps, or the like, as shown in FIGS. 2 and 2A. This is normally completed during fabrication of the jacket, since the caisson will be underwater after platform installation. In use, the heat exchanger of the present invention, comprising the tube bundle and shell, is installed in caisson 2.

Continuing with FIG. 5, as discussed, the heat exchanger consist of the tube bundle T, shell or percolator case 4, and riser or percolator tube 5, inlet pipe 6, and outlet pipe 7. In the exemplary embodiment of the present invention the caisson is a heavy wall steel pipe, which may be from, for example, 18 inches to 24 inches in diameter, depending upon the diameter of the heat exchanger, and extends from a lower deck of the platform (e.g. cellar or sub-cellar decks) to a depth of 45 or more feet below the sea level.

The oil and gas production flowline, carrying the fluid to be cooled, is connected to the inlet pipe 6 at the top of the caisson. The bottom of the caisson is open to the sea 8' and is fitted with a screen device to exclude marine life entering with the seawater.

Because the fluid conveyed in the inlet pipe may be both high temperature and high pressure, and because saltwater is highly corrosive, especially boiling seawater, the inlet pipe 6 is formed of specific materials that are able to withstand the temperature, pressure and corrosive condition of a high temperature, oil and gas production well stream, such as, for example, titanium. It should be welded or otherwise secured to the head cap 9 or bonnet of similar material. As earlier indicated, the head cap is hemispherical or hemi-elliptical in shape, with the bottom or open side welded to a tube sheet 14, also of similar material. The tube sheet may be drilled and counter-bored for attachment to and support of the tubes 10, also earlier discussed in FIG. 6.

Continuing with FIG. 5, the tube sheet interfaces between the head caps and tube ends forming the tube bundle, conveying the hot fluid to be cooled from the inlet pipe to the tube bundle, and from the tube bundle to the outlet pipe. The heads, tube sheets with tubes and baffles make up the tube bundle.

In operation, cold seawater 8' enters the bottom of the caisson and flows counter current to the hot fluids in the tubes. Baffles spaced along the bottom section, create cross flow and increase velocity across the tubes, and promotes effective heat transfer. Further up the tube bundle, the water approaches its boiling point. When the tube wall is above the boiling point of the seawater, boiling occurs along the tube wall, causing bubbles of steam to rise from the upper tube sections and begin to push the water upwards. When the steam bubbles reach the annulus between the hot fluid inlet pipe and the percolator tube, the water and steam enter a slug flow regime—which, it is anticipated, occurs at a superficial velocity of 2–30 fps.

Piston, plug or slug flow, as it is generally known, is a flow pattern in which the gas or vapor portion flows as large plugs. This is a type of liquid pump. The slugs of gas (in this case steam) rise along the hot wall of the inlet pipe, which continues to heat the water. The slug of water 110 is discharged at the upper end of the percolator tube, and dumps into the top of the caisson. The hot seawater leaves the caisson through a set of ports or apertures 21 formed in the caisson, located below sea level.

The system acts as a liquid pump because the steam bubbles reduce the average density of the water/steam mixture to a value at which the weight of the mixture is less than the weight of the seawater at the point where the steam begins to form increasing the energy of the stream generated by the hod fluid being cooled by the water, is expended in pumping the water, causing circulation, thereby increasing the heat transfer rate. The submergence is the distance from sea level to the point of steam formation or boiling on the tube bundle. The lift is the distance from the sea level to the discharge at the top of the percolator tube.

It is important, for maximum effectiveness of the heat exchanger that the boiling is only sufficient to cause the desired amount of circulation of seawater. Too much boiling will blind off the surface area, and reduce heat transfer.

Figure 8:
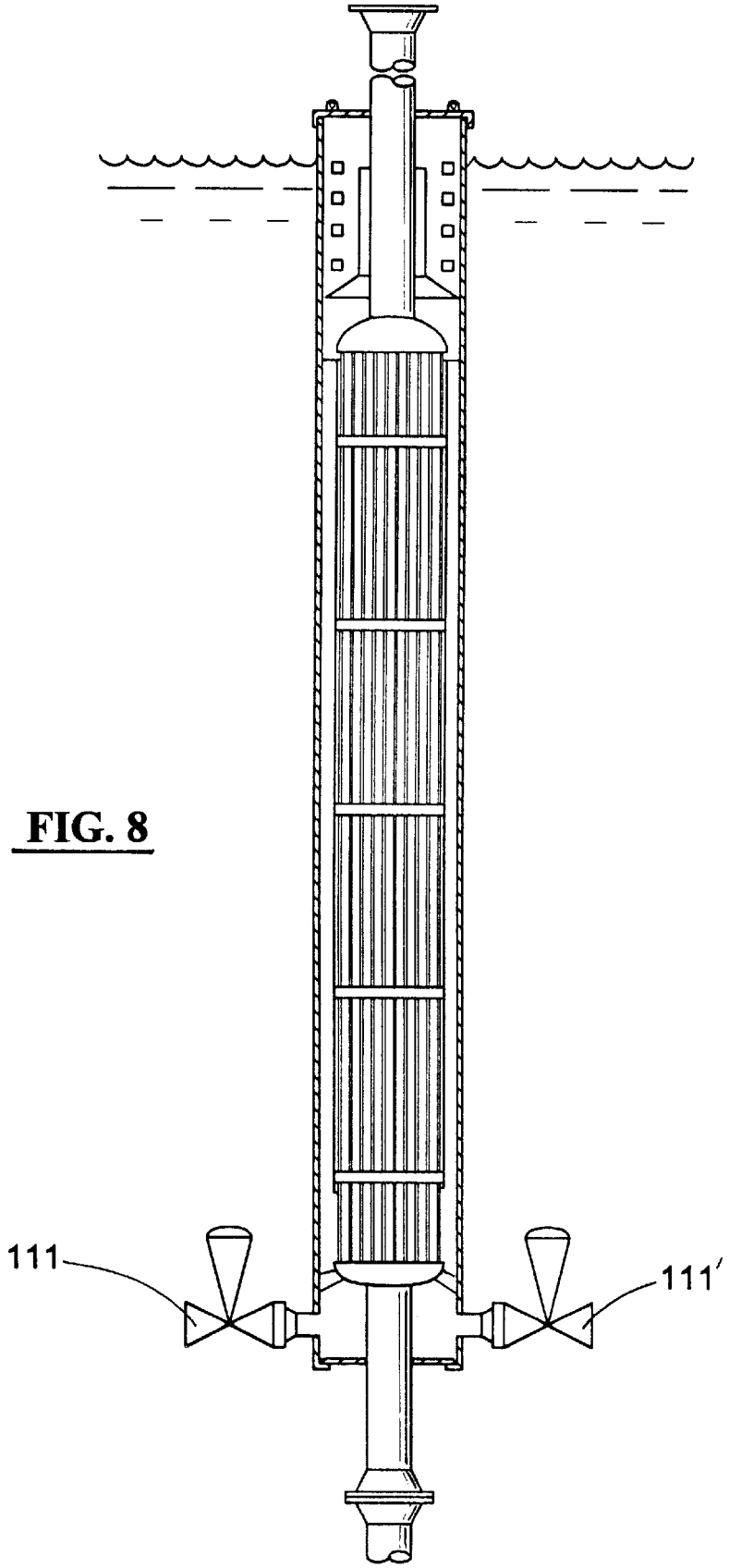
FIG. 8 is a side, partially cut-away view of an alternative embodiment of the present invention, illustrating means for facilitating temperature control in the system in the form of first and second inlet valves for regulating coolant flow into the system.

Referring to FIG. 8, seawater flow control through the heat exchanger can be obtained by sealing the bottom of the caisson with a plate of suitable material, and installing nozzles and/or control valves 111, 111' to control the flow of cooling seawater through the system; two are shown in the drawing, but one to six or more may be added. depending on the size of the valves. Operation of the valves may be used to limit the flow of seawater, in the event the degree of cooling obtained with an open caisson is greater than desired. The control valves may be operated automatically by a temperature controller.

Referring to FIG. 4, the circulation of seawater is obtained when the sum of the resistances to flow—from the bottom of the shell, up and through the tube bundle, and up the percolator pipe, is less than by the hydrostatic driving force.

The resistances to circulation are:

R1—Frictional resistance to seawater flow in the tube bundle;

R2—Frictional resistance in the boiling section, along with expansion and acceleration losses due to vaporization;

R3—Frictional resistance in the percolator tube;

The hydrostatic heads causing circulation in the present invention are as follows:

$Z_1\rho_W$=Product of Length $Z_1$ and the density of water; $\rho_W$ $-Z_2\rho_{HW}$=Negative product of distance $Z_2$ and density of water in the tube bundle; $\rho_{HW}$ $-Z_3\rho_{AVG}$=Negative product of distance $Z_3$ and average density of hot water and steam bubbles $\rho_{AVG}$.

The circulation is obtained when the sum of the resistances (R1+R2+R3) is less than the sum of the driving forces. ($Z_1\rho_W-Z_2\rho_{HW}-Z_3\rho_{AVG}$). The sums must be computed in the same units of pressure.

The percolation tube is therefore an essential feature of the design, for optimal efficiency. It provides the required difference in the hydrostatic head, discharging water and steam above the level of water in the top of the case.

A secondary embodiment of the invention consist of installing a inclined or horizontal tube bundle, in place of the vertical tube bundle, in order to reduce the vertical height of the heat exchanger for installation in shallower water areas. The heat exchanger will have at least one vertical percolator tube, and possibly several as needed to create the necessary circulation of seawater.

The exemplary embodiment, shown in FIG. 5, has an anticipated nominal capacity of 10 million SCFD gas, and is constructed to the following specifications:

Caisson: 18" O.D. steel pipe with a ½" wall thickness

Shell: 12" I.D.×0.125" thick titanium or copper nickel (CuNi) sheet and formed as shown.

Percolator Tube: 6"×0.25" thick titanium pipe.

Percolator Case 12"×0.125" thick titanium or CuNi, rolled.

Tubes: 97–¾" O.D., 16 BWG titanium ASME B338 Gr. 2, Seamless, 30 ft long.

Baffles: ¼" thick titanium plate

Tube Sheets: Titanium or titanium clad monel, of suitable thickness for internal pressure.

Heads: Titanium or titanium clad monel, of suitable thickness for internal pressure.

Inlet Pipe: Titanium or titanium clad monel, of suitable thickness for internal pressure.

Outlet Pipe: Titanium or titanium clad monel, of suitable thickness for internal pressure.

In the exemplary embodiment, the oil and gas production enters the inlet pipe 6 at a pressure of, for example, 2000 psig and temperature of 300° F., at a design flow rate of 10 Million SCFD. The hot fluid flows through the tube sheet 14, and down through the inside of a plurality of tubes 10 forming the tube bundle, where it is cooled by seawater flowing on the outside. The fluid, anticipated to be cooled to approximately 160° F. exits the tube bundle at exit pipe 7.

Cold seawater 8' enters at the bottom 2" of the caisson and flows into the shell at aperture at the lower end 16 of the shell, and is drawn up and around the outside of the tubes by the pumping action of the percolator tube. The cold seawater travels around the baffles 23, 24. The cold water is heated by the hot fluid in the tubes, until, it reaches the boiling point.

When the tube wall temperature is sufficient, the seawater begins to boil and the steam/bubbles rise to the top of the tube bundle, pass between the head 9 and the shell, and in to the annulus between the inlet pipe 6 and the percolator tube 5. Expanding and pushing seawater up the tube 5, the bubbles are being continually heated, and accelerated by their buoyancy; and are discharged via flow 20 at the top of the percolator tube 5 into the caisson. The steam and heated seawater flow back into the surrounding sea through the apertures formed 21 in the caisson.

Figure 7:
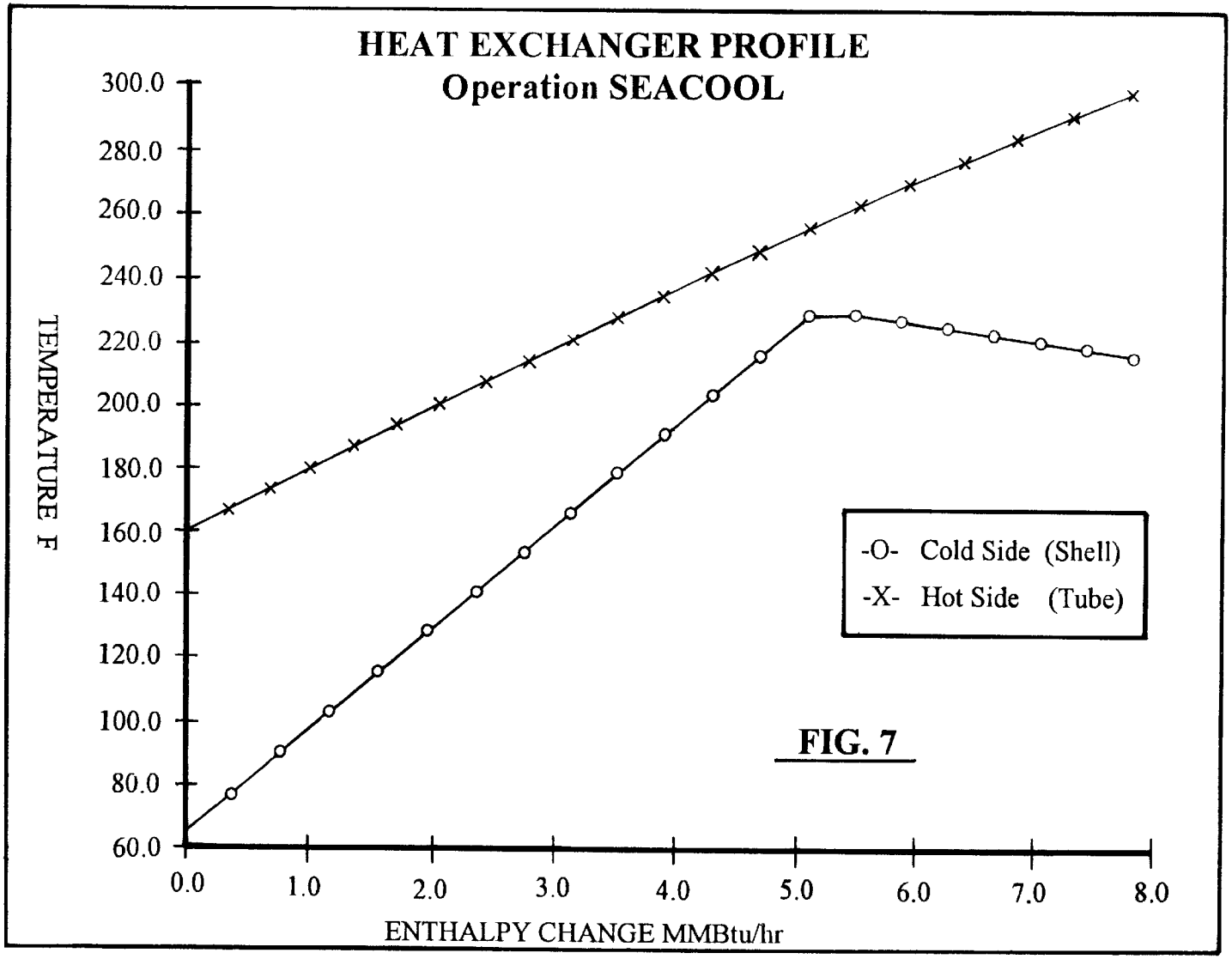
FIG. 7 illustrates anticipated performance criteria for the invention of FIG. 1 in the form of a graph indicating temperature/enthalpy change characteristics of the present system in an exemplary operation.

FIG. 7 presents a typical temperature profile of the water and hot fluid along the tube bundle. The profile curve show how seawater and fluid temperatures change while flowing through the tube bundle. The abscissa in this diagram is the heat transferred from the hot fluid to the seawater. The ordinate is the fluid and seawater temperatures. The profile curves show how the water is first heated from a temperature of 80° F. to approximately 225° F., where boiling begins. When the water reaches the boiling point, the temperature declines somewhat as the hydrostatic head or pressure on the water decreases as it progresses up the tube bundle. At the top of the bundle, the saturation temperature is 215° F. at a hydrostatic pressure of 1.3 psig (16 psia).

Figure 9B:
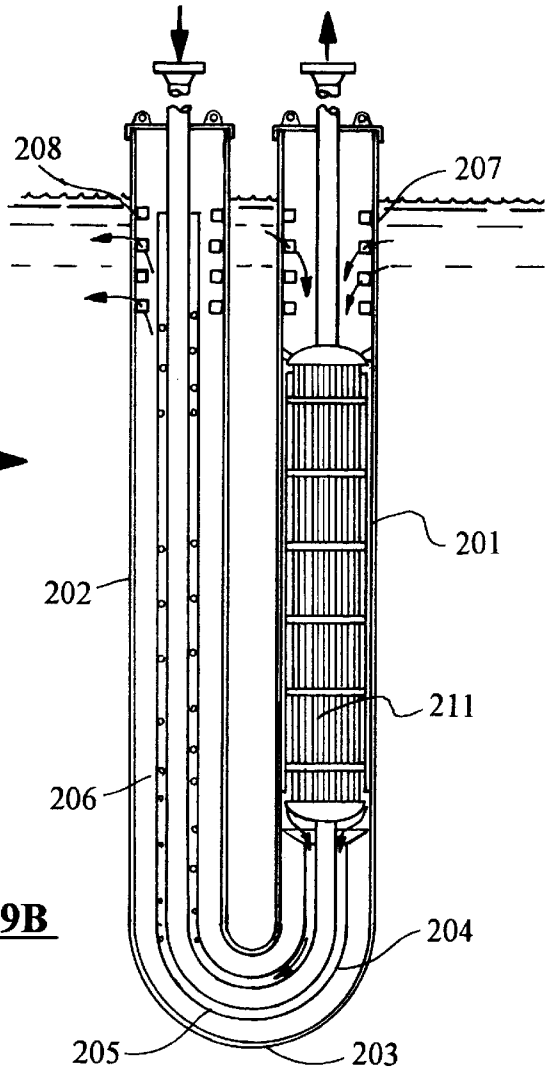
FIG. 9B illustrates a third alternative embodiment of the invention of FIG. 1, illustrating a vertically situated heat exchanger, but with a generally horseshoe configured enveloping caisson and percolator tube.
Figure 9A:
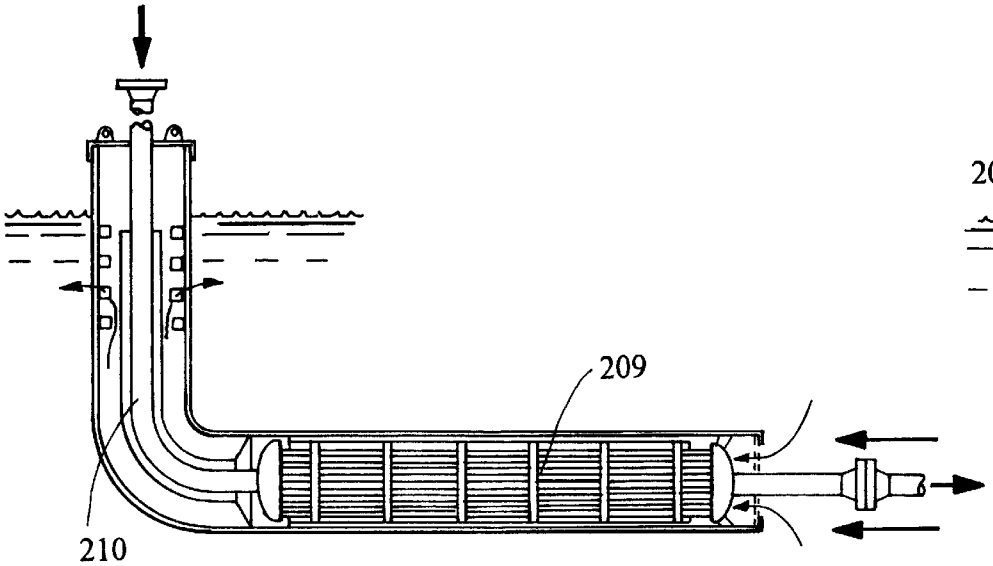
FIG. 9A illustrates a second alternative embodiment of the invention of FIG. 1, illustrating the tube bundle in a horizontal configuration.

FIG. 9A illustrates a second alternative embodiment of the present invention, wherein the tube bundle 209 is situated at a generally horizontal position, with the caisson and percolator tube 210 being curved ninety degrees to form a vertical column, which includes egress ports. This arrangement may be particularly suitable where there exists a horizontal water current within the body of water, providing a horizontal opening for flow of the current into the tube bundle area and through the system.

FIG. 9B is a third alternative embodiment of the present invention, wherein there is provided a horseshoe shaped caisson forming first 201 and second 202 vertical columns, with a curved connection area 203 therebetween, the first 201 column having an ingress port 207 at the top, and containing the tube bundle 211, which communicates with percolator tube 204, which is vertical 204 to a curved 203 area, which then communicates with a vertical column; as with the previous embodiments, the percolator tube envelopes the flow pipe, which has a well stream current counter the coolant flow. Upon passing through the vertical 204 percolator tube area, the seawater coolant begins to form steam bubbles, forming a percolation action to drive the seawater through egress ports 208, causing suction to further facilitate circulation through the system.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. An apparatus for cooling hot fluids in the vicinity of a body of water, comprising:

a heat exchanger column having first and second ends, and an outer diameter, said heat exchanger column configured to receive a flow of said hot fluids; said heat exchanger column further comprising a plurality of longitudinally aligned tubes forming a tube bundle having first and second ends, said first end of said tube bundle configured to engage an inflow pipe to receive a flow of hot fluid, said second end of said tube bundle configured to engage an outflow pipe to facilitate transfer of cooled fluid therefrom;

an elongated housing having a longitudinal axis and first and second ends, said elongated housing having formed along said longitudinal axis a conduit having walls having an inner diameter greater than said outer diameter of said heat exchanger column, said housing having formed in the vicinity of said first end an opening configured to allow the flow of water from said body of water to said conduit, said housing having an opening formed in the vicinity of said second end of said housing to allow the egress of water from said body of water therefrom;

a percolator tube situated about said inflow pipe above said tube bundle, said percolator tube configured to receive steam and heated water flowing from said tube bundle, said percolator tube having a diameter which is less than said tube bundle, said percolator tube configured to facilitate the flow of fluid from said tube bundle, and through said housing;

said housing configured to contain said heat exchanger column, such that said heat exchanger column is situated within said conduit formed in said housing, so as to facilitate the contained flow of water from said body of water through said conduit, and along said heat exchanger column, cooling hot fluids flowing through said heat exchanger column.

2. The apparatus of claim 1, wherein said heat exchanger column comprises a plurality of longitudinally aligned tubes forming a tube bundle having first and second ends, said first end of said tube bundle configured to engage an inflow pipe to receive a flow of hot fluid, said second end of said tube bundle configured to engage an outflow pipe to facilitate transfer of cooled fluid therefrom.

3. The apparatus of claim 2, wherein said heat exchanger column is situated in a generally vertical position.

4. The apparatus of claim 3, wherein said elongated housing comprises a caisson having first and second ends, said first end being open, said second end having formed in the vicinity thereof a plurality of egress apertures.

5. The apparatus of claim 3, wherein there is further provided a sleeve member configured to envelope said tube bundle, and wherein there is further provided a plurality of baffles situated in said tube bundle to facilitate flow of said water throughout said tube bundle.

6. The apparatus of claim 3, wherein there is further provided a plurality of baffles situated within said tube bundle to facilitate flow of said water throughout said tube bundle.

7. The apparatus of claim 1, wherein said tube bundle is situated in a generally horizontal position.

8. An apparatus for cooling hot fluids in the vicinity of a body of water, comprising:

a heat exchanger column having first and second ends, and an outer diameter, said heat exchanger column configured to receive a flow of said hot fluids;

a generally vertically situated elongated housing having a longitudinal axis and first and second ends, said elongated housing having formed along said longitudinal axis a conduit having walls having an inner diameter greater than said outer diameter of said heat exchanger column, said housing having formed in the vicinity of said first end an opening configured to allow the flow of water from said body of water to said conduit, said housing having an opening formed in the vicinity of said second end of said housing to allow the egress of water from said body of water therefrom;

a sleeve member configured to envelope said tube bundle, and wherein there is further provided a plurality of baffles situated in said tube bundle to facilitate flow of said water throughout said tube bundle;

a percolator tube situated above said tube bundle, said percolator tube configured to receive steam and heated water flowing from said tube bundle, said percolator tube having a diameter which is less than said tube bundle, said percolator tube configured to facilitate the flow of fluid from said tube bundle, and through said housing;

said housing configured to contain said heat exchanger column and said sleeve member, such that said heat exchanger column and said sleeve member are situated within said conduit formed in said housing, so as to facilitate the contained flow of water from said body of water through said conduit, and along said heat exchanger column, cooling hot fluids flowing through said heat exchanger column.

9. The apparatus of claim 8, wherein said elongated housing comprises a caisson having first and second ends, said first end being open, said second end having formed in the vicinity thereof a plurality of egress apertures.

10. The apparatus of claim 9, wherein there is provided a percolator tube situated about said inflow pipe above said tube bundle, said percolator tube configured to receive steam and heated water flowing from said tube bundle, said percolator tube having a diameter which is less than said tube bundle, said percolator tube configured to facilitate the flow of fluid from said tube bundle, and through said housing.

11. The method of cooling hot fluids in the vicinity of a body of water, comprising the steps of:

a. providing a heat exchanger column having first and second ends, and an outer diameter, said heat exchanger column configured to receive a flow of said hot fluids therethrough said heat exchanger column formed from a bundle of elongated, longitudinally aligned tubes having a diameter;

b. enveloping said heat exchanger column with a shell having a percolator tube having a lesser diameter than said heat exchanger column, said percolator tube situated above said above said heat exchanger column;

c. providing an elongated housing having a longitudinal axis and first and second ends, said elongated housing having formed along said longitudinal axis a conduit having walls having an inner diameter greater than said outer diameter of said heat exchanger column, said housing having formed in the vicinity of said first end an opening configured to allow the flow of water from said body of water to said conduit, said housing having an opening formed in the vicinity of said second end of said housing to allow the egress of water from said body of water therefrom;

d. placing said housing configured to contain said heat exchanger column, such that said heat exchanger column is situated within said conduit formed in said housing;

e. facilitating the flow of water from said body of water through said conduit, and along said heat exchanger column, contacting said heat exchanger column;

f. heating said water contacting said heat exchanger column to form steam; and g. utilizing said steam to facilitate circulation of said water through said elongated housing, cooling hot fluids flowing through said heat exchanger column.

12. The method of claim 11, wherein in step "a" said heat exchanger column is formed from a bundle of elongated, longitudinally aligned tubes having a diameter, and wherein there is provided the further step of enveloping said heat exchanger column with a shell having a percolator tube having a lesser diameter than said heat exchanger column, situated about said inflow pipe above said above said heat exchanger column.

13. The method of claim 11, wherein in step "g" there is further provided the step of allowing said percolator tube configured to receive steam and heated water flowing from said tube bundle, and allowing said percolator tube to hydrostatically facilitate the flow of fluid from said tube bundle, and through said housing.

14. The method of producing hot, high pressure hydrocarbon gas fluids in the vicinity of a body of water near a hydrocarbon recovery area, comprising the steps of:

a. providing an elongated heat exchanger column formed from a bundle of longitudinally aligned tubes, said heat exchanger column having first and second ends, and an outer diameter, said heat exchanger column configured to receive a flow of said hot fluids therethrough said heat exchanger column further comprising a bundle of elongated, longitudinally aligned tubes having a diameter, b. enveloping said heat exchanger column with a shell having a percolator tube having a lesser diameter than said heat exchanger column, situated about said inflow pipe above said above said heat;

c. providing an elongated housing having a longitudinal axis and first and second ends, said elongated housing having formed along said longitudinal axis a conduit having walls having an inner diameter greater than said outer diameter of said heat exchanger column, said housing having formed in the vicinity of said first end an opening configured to allow the flow of water from said body of water to said conduit, said housing having an opening formed in the vicinity of said second end of said housing to allow the egress of water from said body of water therefrom;

d. placing said elongated housing such that said heat exchanger column is situated in a generally vertical position within said conduit formed in said housing, and said heat exchanger column is situated in a generally vertical, longitudinally aligned position with said housing, said housing and said heat exchanger column in contact with said body of water;

e. facilitating the flow of water from said body of water through said conduit, and along said heat exchanger column, contacting said heat exchanger column;

f. heating said water contacting said heat exchanger column; and g. utilizing said heated water to facilitate thermosyphonic circulation of said water into and through said elongated housing, cooling hot fluids flowing through said heat exchanger column.

15. The method of claim 14, wherein in step "g" there is further provided the step of allowing said percolator tube to receive steam and heated water flowing from said tube bundle, and allowing said percolator tube to hydrostatically facilitate the flow of fluid from said tube bundle, and through said housing.

16. A system for cooling a hot fluid flow through a pipe situated near a body of water, comprising:

a generally vertically situated, elongated tube bundle comprised of a plurality of longitudinally aligned tubes configured to receive said hot fluid flow from said pipe;

an enveloping caisson situated about said elongated tube bundle, said enveloping caisson having a first, open, lower end, and a second, upper end;

thermosyphonic means for facilitating the flow of water from said body of water through said enveloping caisson and about said elongated tube bundle, so as to cool said hot fluid flow while maintaining circulation of said water through said system;

a sleeve member configured to envelope said tube bundle, and wherein there is further provided a plurality of baffles situated in said tube bundle to facilitate flow of said water throughout said tube bundle;

a percolator tube situated above said tube bundle, said percolator tube configured to receive steam and heated water flowing from said tube bundle, said percolator tube having a diameter which is less than said tube bundle, said percolator tube configured to facilitate the flow of fluid from said tube bundle.

17. The apparatus of claim 16, wherein there is further provided a sleeve member configured to envelope said tube bundle, and wherein there is further provided a plurality of baffles situated in said tube bundle to facilitate flow of said water throughout said tube bundle.

18. The apparatus of claim 17, wherein there is provided first and second baffles situated in the vicinity of said tube bundle to facilitate enhanced circulation of said water about said tube bundle.

19. The apparatus of claim 7, wherein said caisson is configured in a generally horseshoe configuration.

* * * * *